US005944515A

United States Patent [19]

Gilmore et al.

[11] Patent Number: 5,944,515

[45] Date of Patent: Aug. 31, 1999

[54] REVERSING AIR FLOW OVEN

[75] Inventors: Anthony E. Gilmore, Northville; Donald Fischer, Livonia, both of Mich.

[73] Assignee: Moco Thermal Industries, Incorporated, Romulus, Mich.

[21] Appl. No.: 08/968,166

[22] Filed: Nov. 12, 1997

[51] Int. Cl.[6] ..... F27B 9/00

[52] U.S. Cl. ..... 432/144; 432/148; 432/152; 432/136

[58] Field of Search ..... 432/143, 144, 432/145, 146, 148, 152, 181, 176, 136, 137, 138

[56] References Cited

U.S. PATENT DOCUMENTS

| | | | |
|---|---|---|---|
| 1,409,119 | 3/1922 | Scanlon et al. . | |
| 2,160,610 | 5/1939 | Witting . | |
| 2,169,621 | 8/1939 | Taylor . | |
| 3,113,766 | 12/1963 | Guingand . | |
| 3,170,680 | 2/1965 | Keefer . | |
| 3,349,791 | 10/1967 | Guzman et al. . | |
| 3,770,050 | 11/1973 | Nakanishi . | |
| 3,773,066 | 11/1973 | Tyrner et al. . | |
| 4,162,141 | 7/1979 | West | 432/145 |
| 4,412,815 | 11/1983 | White et al. . | |
| 4,496,312 | 1/1985 | Yamada et al. | 432/138 |
| 4,588,378 | 5/1986 | Yamamoto et al. | 432/144 |
| 4,596,526 | 6/1986 | Soliman . | |
| 5,044,944 | 9/1991 | Furuya et al. | 432/136 |
| 5,195,673 | 3/1993 | Irish et al. . | |

*Primary Examiner*—Teresa Walberg
*Assistant Examiner*—Jiping Cu
*Attorney, Agent, or Firm*—Harness, Dickey & Pierce, P.L.C.

[57] ABSTRACT

A reverse air flow oven for symmetrically heating product inserted within a heating chamber in the oven. The oven includes duct work configured symmetrically about the heating chamber, and a fan provides continuous circulation through the duct work and the heating chamber. The duct work also includes a pair of doors having complimentary configurations so that in one configuration, the air flow is in a first direction, and in the complimentary configuration, the doors cause air flow in the opposite direction. Further, a perforated plate regulates and equalizes air flow across the heating chamber and includes valve plates for controlling a build up of static pressure within the heating chamber.

28 Claims, 4 Drawing Sheets

REVERSING AIR FLOW OVEN

BACKGROUND OF THE INVENTION

1. Field of the Invention

The present invention relates to an industrial oven which heats product by circulating air internally through the oven, and more particularly, to an industrial oven which enables air to flow in a continuous, reversible path by opening and closing vent doors arranged in a particular configuration, wherein the paths are substantially symmetric.

2. Discussion

Reversible air flow, industrial ovens have long been used for heating, reheating, preheating, precipitation, hardening, and homogenizing, annealing and curing a varied assortment of products. The reversibility of air flow is typically desirable because when heating a product to a predetermined temperature in an air flow oven, a temperature gradient forms across the product with the upwind edge of the product obtaining a substantially higher temperature than the downwind edge. The temperature gradient forms because the air flow loses heat as it traverses the product.

While the use of the reverse air flow oven is particularly desirable, several characteristics of the, prior art reverse air flow industrial ovens prove to be somewhat undesirable. For example, present reverse air flow ovens fail to provide symmetric heating profiles for each direction of air flow. Typically, one direction provides a suitable heating profile, while the opposite direction exhibits a substantial decrease in the heating profile. Often, this decrease in the profile may be twenty percent or higher. Further, because it is desirable to provide a substantially symmetric path for the air flow, Present reverse air flow ovens route the air flow non-symmetrically about the product by reversing of the air circulation mechanism, such as a fan. This inherently leads to asymmetric profiles even though the air flow path may be symmetric. The asymmetric profile results from the air circulation mechanism, the fan, having a diminished capacity to move air in one direction verses the other.

Reversing the air circulation mechanism can also result in other considerations becoming more relevant. In particular, power usage and the process of reversing the air flow must be carefully examined. For example, the volume of air circulating in large industrial ovens necessarily requires circulation fans of substantial size which draw substantial amounts of electrical power. Reversing such fans also necessarily requires substantial energy in order to effect dynamic breaking of the fan and additional substantial energy in order activate the fan in the reverse direction. The electrical requirements not only consume considerable electrical energy, they often necessitate installation of specialized circuitry to carry out. When the fans are deactivated in order to reverse the direction of the fan and thus the air flow becomes much more relevant. The air flow proper heating of the product. For example, when the fan is slowed in preparation for reversing its direction, the heat source for the oven must also be deactivated so as to not generate hot spots near the heat source because air in proximity to the heat source becomes temporarily stagnant. When the fan is reactivated in the reverse direction, reactivation of the heat source must typically be in accordance with the air flow as the fan ramps up to full speed. Existing air flow ovens take approximately 1½ minutes to stabilize during this air flow reversal process. It is generally desirable to reverse the air flow frequently. However, because of the above considerations, existing air flow ovens often reverse air flow only every hour. This results in a substantial heating of product in the upwind section of air flow and substantially diminished heating of the product in the downwind portion of the air flow. Thus, it is the object of the present invention to provide a reverse air flow oven which provides a symmetric heating profile along the product, regardless of the direction of air flow.

It is a further object of the present invention to provide a reverse air flow oven in which the air flow may be reversed by directing the air flow through duct work, rather than reversing the direction of the circulation fan.

It is yet a further object of the present invention to provide a reverse air flow oven in which air flow may be reversed frequently with a minimum input of electrical energy and a minimum stabilization period.

It is yet a further object of the present invention to provide a reverse air flow oven in which the air flow is substantially symmetric with respect to the product.

It is yet a further object of the present invention to achieve uniform heating and temperature uniformity in the air stream by uniformly distributing the air over a duct face which contains a mechanism for distributing the air and velocity pressure.

SUMMARY OF THE INVENTION

This invention is directed to an industrial oven for heating a product in which the oven has a reverse air flow capability. The oven includes a heat source for achieving a predetermined temperature within the oven. A fan circulates air within the oven, and a chamber receives the product. The circulating air passes through the chamber. A number of ducts for directing the circulating air through the oven, and the circulating air follows a continuous path which includes the ducts and the chamber. A pair of flow reversal doors are positioned in the continuous path and enable the reversal of the direction of the continuous path of the air flow. When the doors are in a first configuration, air circulates in a first direction, and the doors are in a second configuration, the air circulates in an opposite direction.

These and other advantages and features of the present invention will become readily apparent from the following detailed description, claims and drawings.

BRIEF DESCRIPTION OF THE DRAWINGS

The drawings, which form an integral part of the specification, are to be read in conjunction therewith, and like reference numerals are employed to designate identical components in the various views.

DETAILED DESCRIPTION OF THE PREFERRED EMBODIMENTS

Figure 1:
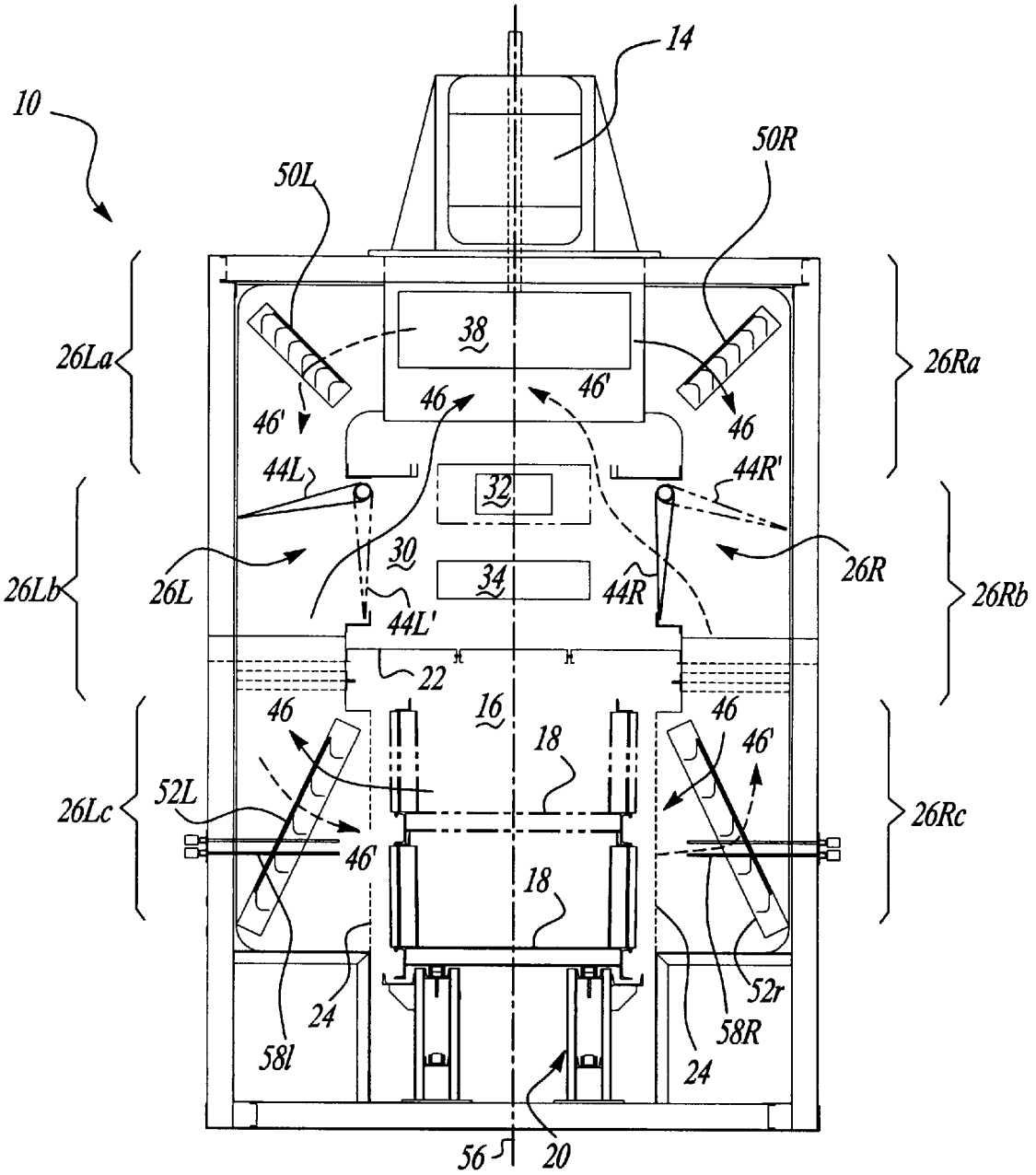
FIG. 1 is an elevational view in partial cross section of the reverse air flow oven arranged in accordance with the principals of the present invention.
Figure 2:
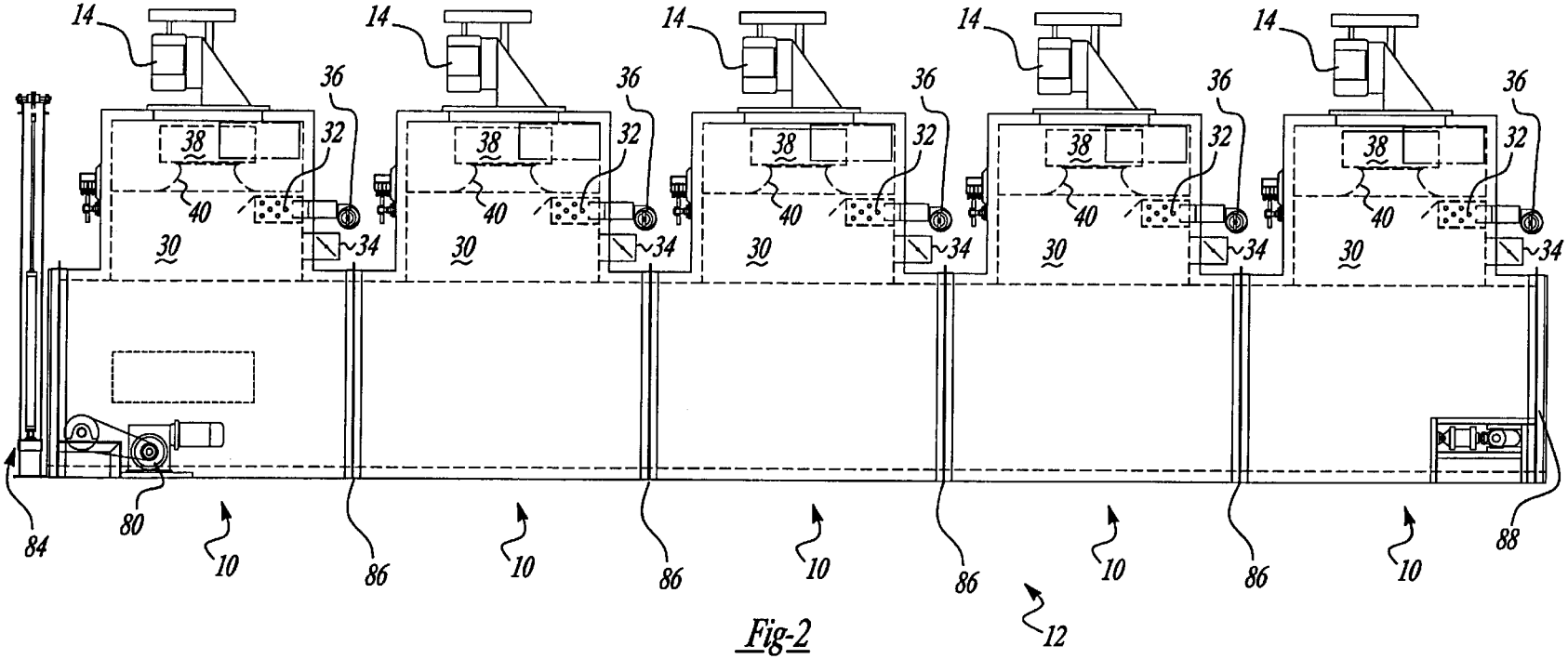
FIG. 2 is an elevational view of a plurality of reverse air flow ovens linked together to form a larger reverse air flow oven.
Figure 4:
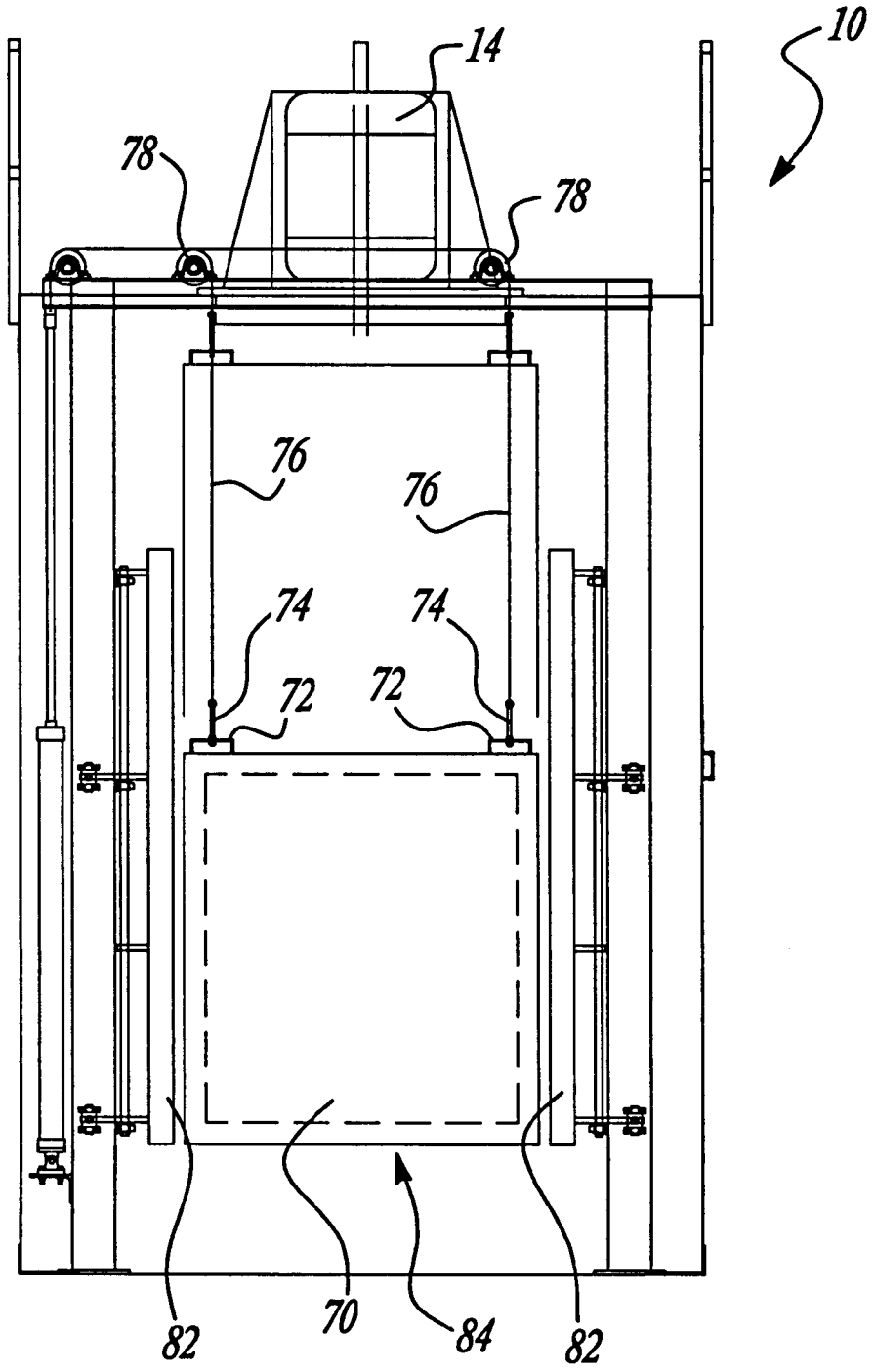
FIG. 4 is an elevational view of the reverse air flow oven of the present invention, including doors to close and seal the oven.

FIGS. 1,2 and 4 depict an industrial oven and FIG. 2 depicts individual industrial ovens 10 arranged in sequence, FIG. 1, to provide a larger industrial oven 12. Industrial oven 10 includes a fan 14, which may be a backwardly inclined scroll fan or any other fan know to those skilled in the art. The fan 14 is mounted on top of the oven and circulates the air within the oven 10. The interior of the oven 10 includes a heating chamber 16 in which product for heating (not shown) is placed on a pair of racks 18. The racks 18 are moved into and out of the interior of the oven 10 by means of conveyer assembly 20. Heating chamber 16 is covered by a top wall 22 and is bordered on the sides by perforated side walls or plates 24. The perforated side walls or plates 24 enable equalization of air flow across the entirety of the product in heating chamber 16, as will be described herein.

Industrial oven 10 also includes duct work for routing a continuous air flow path through oven 10, including heating chamber 16. The duct work comprises a left heating duct 26L and right duct 26R. To better highlight the symmetry of industrial oven 10, like elements will be referred to using like reference numeral with a suffix of L and R to indicate that the elements are located on the left and right sides of the oven, respectively. The duct's 26L, 26R are positioned adjacent to heating chamber 16. Above heating chamber 16 temperature control section 30 is placed between ducts 26L and 26R. Temperature control 30 includes a heat inlet 32 through which air at a predetermined temperature is introduced in order to maintain the interior temperature of oven 10 at a predetermined temperature. A burner 36 or other heat source provides air at an elevated temperature for introduction through heat inlet 32. Fresh air vent 34 enables the introduction of fresh air into temperature control section 30 in order to balance temperature control section 30.

An air return section 38 is placed above temperature control section 30 so that air drawn through temperature control 30 is drawn into air return section 38. Air return section 38 is placed between ducts 26L and 26R. A vent 40 connects temperature control section 30 and air return section 38 and is shaped to facilitate air flow into air return section 38 from temperature control chamber 30. Further, ducts 26L and 26R may be viewed as comprising three sections. An upper section 26L*a*, 26R*a* is generally adjacent to return air section 30. A second section 26L*b*, 26R*c* is generally adjacent to temperature control section 30. A third section 26L*c*, 26R*c* is generally adjacent to heating chamber 16.

Of particular interest in the present invention are air flow doors 44L and 44R which typically assume either an air return position, demonstrated by door 44L, or an air inlet position, demonstrated by door 44R. In accordance with the present invention, the particular position of doors 44L, 44R determine the direction of the air flow through the oven 10 and heating chamber 16, in particular. As shown in FIG. 1, door 44L inhibits air flow between left duct sections 26L*a* and 26L*b* and enables air flow between left duct section 26L*b* and temperature control section 30. Door 44R inhibits air flow between right duct section 26R*b* and temperature control section 30 and enables air flow between right duct sections 26R*a* and 26R*b*. With respect to the configuration of doors 44L, 44R in FIG. 1, the direction of air flow is shown by arrows 46. Starting at return air section 38, the circulating air flows downward through upper section 26R*a*, middle section 26R*b*, and lower section 26R*c* of right duct 26R. Air then flows through heating chamber 16 and into left duct 26L. In left duct 26L, air flows from bottom section 26L*c* to middle section 26L*b*. From middle section 26L*b*, air flows into temperature control section 30 then back to return chamber 38.

To facilitate air flow and to facilitate directional changes, duct sections 26R*a* and 26R*b* includes turning vanes. Right duct 28R includes a set of turning vanes 50R to assist in redirecting air from return air section 38 through duct 26R. Right duct 26R also includes a second set of turning vanes 52R for redirecting air from lower section 26R*c* into heating chamber 16. Similarly, left duct 26L includes a set of turning vanes 52L to redirect air output from heating chamber 16 into duct 26L. Further yet, section 26L*a* of duct 26 also includes a set of turning vanes 50L which operate similarly to turning vanes 50R when air flows in the reverse direction. One skilled in the art will recognize that the turning vanes operate similarly when the air flow is reversed. Note that turning vanes 50R, 50L and 52R, 52L are angled with respect to the vertical in order to provide a substantially even air flow at the output side of the turning vanes.

In a reverse configuration, left vent door 44L assumes a generally vertical position 44L', shown in phantom, and right vent door 44R assumes a generally horizontal position at 44R', also shown in phantom. In this configuration, the doors 44L' and 44R' operate complimentary from doors 44R and 44L respectively, and the airflow is reversed as shown by arrows 46' in phantom. In this reverse air flow configuration, air circulation 46' covers a path symmetric about a center line 56 of oven 10. Thus, regardless of the direction of air flow, the heating profile of the product within heating chamber 16 is symmetric about center line 56 of industrial oven 10. This results in a symmetric heating of the product in heating chamber 16.

Doors 44L, 44R are typically opened and closed using a mechanical mechanisim attached to the doors so that movement of the mechanism causes that door to move accordingly. The mechanism is mechanically connected with a linkage so that movement of the mechanism causes both doors to move in complementary directions. Further positive pressure appears within temperature control section 30, and assists in first moving one of the doors 44R, 44L, whichever is in a generally vertical position. The positive pressure assists in pushing the generally vertical door outward, thereby creating a pressure assist for moving the door from a generally vertical to a generally horizontal position.

To further assist in symmetric heating of the product within heating chamber 16 a pair of thermocouples 58L is placed in section 26L*c* adjacent to heating chamber 16. Similarly, a pair of thermocouples 58R is placed in chamber 26R*c* adjacent to heating chamber 16. Thermocouples 58R, 58L further enable symmetric operation of the oven as one set of thermocouples 58L, 58R is used to measure temperature a first direction of air flow, and the other set of thermocouples 58L, 58R is used to measure temperature in a reverse direction of air flow. In a preferred embodiment, when the air flow is in a direction indicated by arrows 46, thermocouples 58R are activated in order to measure the air temperature of the air as it enters heating chamber 16. Similarly, when the direction of air flow is as indicated by arrows 46', thermocouples 58L are activated in order to once again measure the temperature of the air prior to entering heating chamber 16.

With reference with to FIG. 2, a particular configuration of an industrial oven 12 is shown. A plurality of individual ovens 10 is aligned adjacently to form a larger oven 12. In this way, products of varying lengths can be accommodated by simply adding additional industrial ovens 10 to the plurality.

Figure 3:
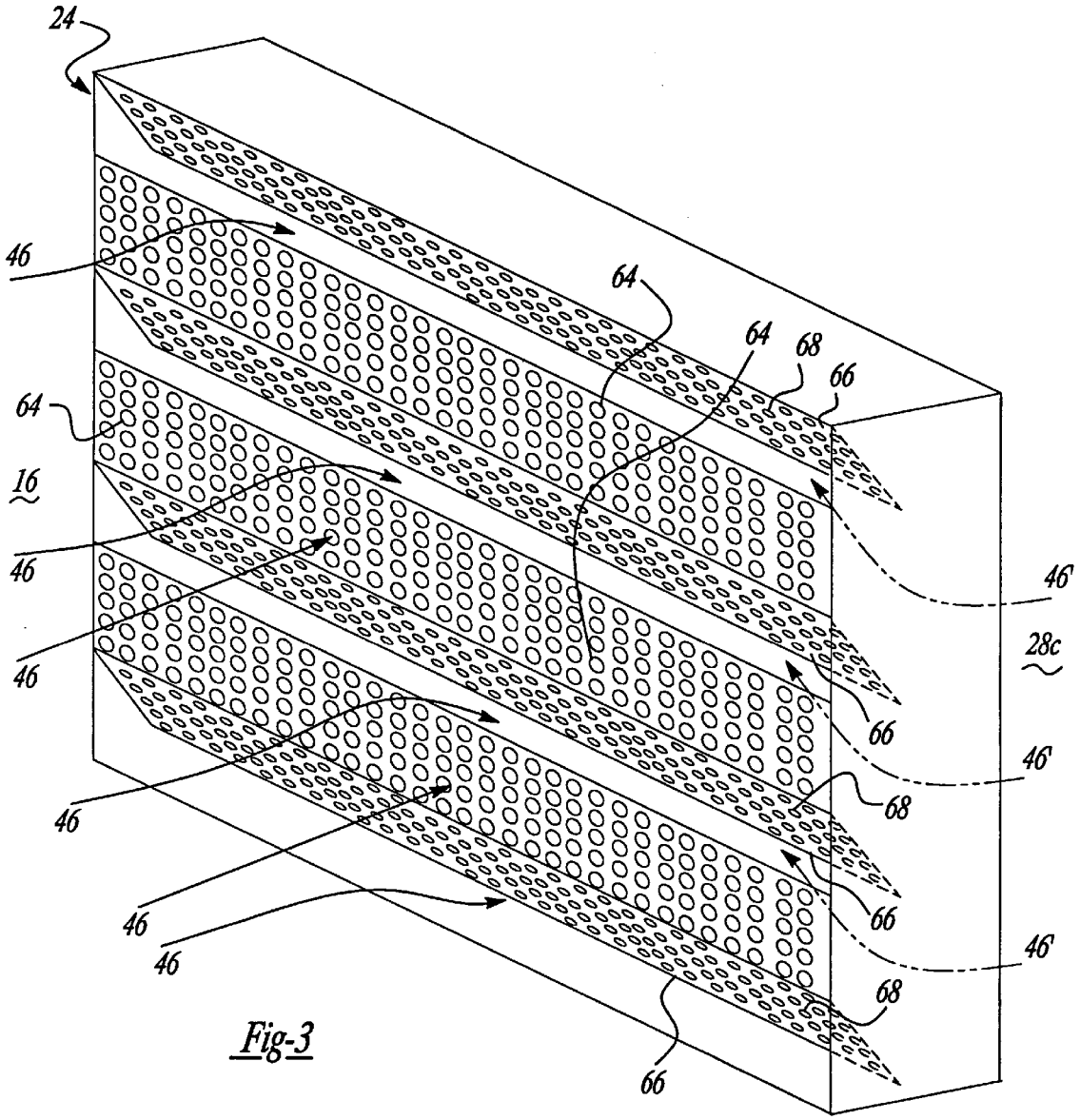
FIG. 3 is a perspective view of the relief valves for controlling static pressure within the heating chamber.

With reference with FIG. 3, the perforated plate assembly 24 for equalizing air flow across the entirety of heating chamber 16 is shown. Perforated chamber 24 includes a plurality of perforations 64 which regulate and substantially equalize air flow across heating chamber 16. In addition, the perforated plates 24 include valve plates 66 which assist in controlling in static pressure in order to provide a uniform return air flow exiting heating chamber 16. The perforated plate assembly 24 and accompanying valve plates 64 shown in FIG. 3 depict the perforated plate as positioned on the outlet side of heating chamber 16. Arrows 46 indicate the direction of air flow through perforated plate assembly 24.

Valve plates 64 maybe attached to perforated plate 24 using hinges. When the pressure differential across the valve plates 64 reaches a predetermined value, the valve plates 64 swing open in order to increase the air flow exiting heating chamber 16, thereby decreasing static pressure. When air flow is in a reverse, as indicated by arrows 46', valve plates 66 swing to a generally vertical closed position. Because of perforations 68 within valve plates 66, when in a closed position the perforation 68 in valve plates 66 assist in substantially equalizing the air flow across the heating chamber 16.

With reference with FIG. 4, an external view of oven 10 depicts another feature of the present invention. Oven 10 includes a door 70 for opening and closing the oven to enable the insertion of the product therein. The door 70 includes a pair of rings 72 to which is attached a pair of hooks 74 for lifting the door 70 by the rings 72. A pair of cables 76 attache to the hooks and pass through a pair of pulleys 78. The cables 76 are connected to a rotating drum which is turned by a motor 80, show in FIG. 2. Operation of the motor 80 to rotate the drum enables the raising and lowering of the door 70 in order to open and close the oven. During the raising and lowering operation, the door 70 rides with a pair of lift tracks 82 which vertically guide the door 70 during the raising and lowering operation. The door 70 and the accompanying components comprise a door assembly 84. With reference to FIG. 2, the door assembly is shown towards the left side FIG. 2. In this manner, the oven 12 comprises a plurality of individual zones or ovens 10 which are sealable linked together at joints 86. Further, the conveyer 20, of FIG. 1 substantially traverses the length of the oven 12. At the far right of the oven 12, the end wall 88 is sealed so that the product only enters toward the left side through door assembly 84.

In view of the foregoing, one can see that operation of the reverse air flow oven, significantly meets the objects of the present invention. In particular, the oven 10 is configured in order to provide symmetric air flow, including symmetry of a pathway and the volume of air moving through the pathway within the oven. Further, the direction of air flow may be reversed by simply varying the configuration of the vent doors 44L, 44R, thereby alleviating the necessity to reverse the direction of the fan. In this manner, the fan 14 operates continuously to circulate the air through the oven.

While specific embodiments have been shown and described in detail to illustrate the principles of the present invention, it will be understood that the invention may be embodied otherwise without departing from such principles. For example, one skilled in the art will readily recognize from such discussion and from the accompanying drawings and claims that various changes, modifications and variations can be made therein without departing from the spirit and scope of the invention as described in the following claims.

We claim:

1. An industrial oven for heating a product comprising:

a heat source for heating air to a predetermined temperature within the oven;

a fan for causing air circulation of the heated air within the oven;

a chamber for receiving the product, the circulating air passing through the chamber;

a pair of duct assemblies, each of the duct assemblies providing a flow path for directing the circulating air from the heat source to the chamber in a first arrangement and for providing a flow path for directing the circulating air from the chamber to the heat source in a second arrangement, wherein the circulating air follows a continuous path including one of the pair of duct assemblies, the chamber, the other of the pair of duct assemblies, and the heat source in a first direction, and the circulating air follows a continuous path including the other of the pair of duct assemblies, the chamber, the one of the pair of duct assemblies, and the heat source in an opposite direction; and a pair of flow reversal doors, one of the pair of flow reversal doors placed in a respective one of the pair of duct assemblies for reversing the direction of the continuous path, wherein when the flow reversal doors are in a first configuration, air circulation is in the first direction and when the flow reversal doors are in a second configuration, air circulation is in the opposite direction.

2. The apparatus of claim 1 wherein the continuous path is symmetrical so that the continuous path is substantially the same in either the first or the opposite directions.

3. The apparatus of claim 2 further comprising a first and second side opening coincident with the chamber, wherein a plurality of ovens may be positioned adjacently to form a larger oven.

4. The apparatus of claim 2 further comprising:

an opening coincident with the chamber for inserting the product into the chamber; and a door for opening and closing the oven, wherein the door slides in a first direction to cover the opening to close the oven and slides in an opposite direction to uncover the opening to open the oven.

5. The apparatus of claim 2 further comprising a conveyer for moving the products into and out of the chamber.

6. The apparatus of claim 1 further comprising:

a heating section receiving heat from the heat source for heating circulating air;

an air return section for receiving the circulating air from the heating section;

one of the duct assemblies further comprising a first side duct including a top, middle, and bottom section, the top section communicating with the air return section, the bottom section communicating with the chamber, and the middle section interconnecting the top section, the bottom section, and the heating section, wherein when a first of the pair of flow reversal doors is in an inlet position, the first flow reversal door restricts circulating air flow between the bottom section and the heating section and enables circulating air flow between the top section and the bottom section, and when the first flow reversal door is an outlet position, the first flow reversal door restricts circulating air flow between the top section and the bottom section and enables air flow between the bottom section and the heating section; and the other of the duct assemblies further comprising a second side duct including a top, middle, and bottom section, the top section communicating with the air return section, the bottom section communicating with the chamber, and the middle section interconnecting the top section, the bottom section, and the heating section, wherein when a second of the pair of flow reversal doors is in an inlet position, the second flow reversal door restricts circulating air flow between the bottom section and the heating section and enables circulating air flow between the top section and the bottom section, and when the second flow reversal door in an outlet position, the second flow reversal door restricts circulating air flow between the top section and the bottom section and enables circulating air flow between the bottom section and the heating section;

wherein the first and second flow reversal doors are generally in complimentary positions.

7. The apparatus of claim 6 wherein the chamber, the heating section, and the air return section are symmetric about and arranged along a line of symmetry of the oven, and the first and second ducts are symmetric and positioned adjacent to and on opposite sides of the chamber, heating section, and air return section, thereby forming a symmetric, continuous path.

8. The apparatus of claim 6 further comprising:

a first set of chamber turning vanes to direct the circulating air between one of the first and second ducts and the chamber; and a second set of chamber turning vanes to direct the circulating air between the other of the first and second ducts and an opposite side of the chamber.

9. The apparatus of claim 8 wherein the first set of chamber turning vanes is in the bottom section of the one duct and the second set of chamber turning vanes is in the bottom section of the other duct.

10. The apparatus of claim 6 further comprising:

a first set of top turning vanes to direct the circulating air in the top section of one of the first and second ducts toward the middle section of the one duct; and a second set of top turning vanes to direct the circulating air in the top section of the other of the first and second ducts toward the middle section of the other duct.

11. The apparatus of claim 10 wherein the first set of top turning vanes is in the top section of the one duct and the second set of top turning vanes is in the top section of the other duct.

12. The apparatus of claim 6 wherein a first perforated plate separates the bottom section of one of the first and second ducts from the chamber and a second perforated plate separates the other of the first and second ducts from the chamber.

13. The apparatus of claim 12 wherein the first and second perforated plates each further comprise a valve plate attached thereto to regulate static pressure.

14. The apparatus of claim 13 wherein the respective valve plates are perforated and hingedly attach to the perforated plates, the valve plates swinging outwardly toward the respective bottom section when air flows from the chamber toward the respective bottom section.

15. An apparatus, comprising:

a heat source for heating air to a predetermined temperature within a reverse air flow oven;

a fan for causing air circulation of the heated air within the reverse air flow oven;

a chamber for receiving the product, the circulating air passing through the chamber;

a pair of duct assemblies, each of the duct assemblies providing a flow path for directing the circulating air from the heat source to the chamber in a first arrangement and for providing a flow path for directing the circulating air from the chamber to the heat source in a second arrangement, wherein the circulating air follows a continuous path including one of the pair of duct assemblies, the chamber, the other of the pair of duct assemblies, and the heat source in a first direction, and the circulating air follows a continuous path including the other of the pair of duct assemblies, the chamber, the one of the pair of duct assemblies, and the heat source in an opposite direction, wherein the continuous path is symmetric so that the continuous path is substantially the same in either the first or opposite directions; and a pair of flow reversal doors, one of the pair of flow reversal doors placed in a respective one of the pair of duct assemblies for reversing the direction of the continuous path, wherein when the flow reversal doors are in a first configuration, air circulation is in the first direction and when the flow reversal doors are in a second configuration, air circulation is in the opposite direction.

16. The apparatus of claim 15 wherein the continuous path further comprises:

a heating section communicating with the heat source for heating the circulating air.

17. The apparatus of claim 16 further comprising:

the one duct assembly including a first side duct including a top, middle, and bottom section, the top section communicating with the air return section, the bottom section communicating with the chamber, and the middle section interconnecting the top section, the bottom section and the heating section, wherein when a first of the pair of flow reversal doors is in an inlet position, the first flow reversal door restricts circulating air flow between the bottom section and the heating section and enables circulating air flow between the top section and the bottom section, and when the first flow reversal door is an outlet position, the first flow reversal door restricts circulating air flow between the top section and the bottom section and enables circulating air flow between the bottom section and the heating section; and the other duct assembly including a second side duct including a top, middle, and bottom section, the top section communicating with the air return section, the bottom section communicating with the chamber, and the middle section interconnecting the top section, the bottom section, and the heating section, wherein when a second of the pair of flow reversal doors is in an inlet position, the second flow reversal door restricts circulating air flow between the bottom section and the heating section and enables circulating air flow between the top section and the bottom section, and when the second flow reversal door is in an outlet position, the second flow reversal door restricts circulating air flow between the top section and the bottom section and enables circulating air flow between the bottom section and the heating section;

wherein the first and second flow reversal doors are generally in complementary positions.

18. The apparatus of claim 17 further comprising:

a first set of turning vanes to direct the circulating air between the one of the first and second ducts and the chamber; and a second set of chamber turning vanes to direct the circulating air between the other of the fist and second ducts and an opposite side of the chamber.

19. The apparatus of claim 18 further comprising:

a first set of top turning vanes to direct the circulating air in the top section of one of the first and second ducts toward the middle section of the one duct; and a second set of top turning vanes to direct the circulating air in the top section of the other of the first and second ducts toward the middle section of the other duct.

20. The apparatus of claim 17 wherein a first perforated plate separates the bottom section of one of the first and second ducts from the chamber and a second perforated plate separates the other of the first and second ducts from the chamber.

21. The apparatus of claim 20 wherein the first and second perforated plates each further comprise a valve plate attached thereto to regulate static pressure within the chamber.

22. An industrial oven for heating a product comprising:

a heat source for heating air to a predetermined temperature within the oven;

a fan for causing air circulation of the heated air within the oven;

a chamber for receiving the product, the circulating air passing through the chamber;

a pair of duct assemblies, each of the duct assemblies providing a flow path for directing the circulating air from the heat source to the chamber in a first arrangement and for providing a flow path for directing the circulating air from the chamber to the heat source in a second arrangement, wherein the circulating air follows a continuous path including one of the pair of duct assemblies, the chamber, the other of the pair of duct assemblies, and the heat source in a first direction, and the circulating air follows a continuous path including the other of the pair of duct assemblies, the chamber, the one of the pair of duct assemblies, and the heat source in an opposite direction; and a flow reversal device formed in the continuous path for reversing the direction of the continuous path, wherein when the flow reversal device is in a first configuration, the circulating air flows in the first direction and when the flow reversal device is in a second configuration, the circulating air flows in the opposite direction.

23. The apparatus of claim 22 wherein the continuous path is symmetric so that the continuous path is substantially the same in either the first or the opposite directions.

24. The apparatus of claim 22 further comprising:

a heating section receiving heat from the heat source for heating circulating air;

an air return section for receiving the circulating air from the heating section;

one of the duct assemblies further comprising a first side duct including a top, middle, and bottom section, the top section communicating with the air return section, the bottom section communicating with the chamber, and the middle section interconnecting the top section, the bottom section, and the heating section, wherein when the flow reversal device is in a first position, the flow reversal device restricts circulating air flow between the bottom section and the heating section and enables circulating air flow between the top section and the bottom section, and when the flow reversal device is in a second position, the flow reversal device restricts circulating air flow between the top section and the bottom section and enables air flow between the bottom section and the heating section; and the other of the duct assemblies further comprising a second side duct including a top, middle, and bottom section, the top section communicating with the air return section, the bottom section communicating with the chamber, and the middle section interconnecting the top section, the bottom section, and the heating section, wherein when the flow reversal device is in the second position, the flow reversal device restricts circulating air flow between the bottom section and the heating section and enables circulating air flow between the top section and the bottom section, and when the flow reversal device is in the first position, the flow reversal device restricts circulating air flow between the top section and the bottom section and enables circulating air flow between the bottom section and the heating section.

25. The apparatus of claim 24 wherein the chamber, the heating section, and the air return section are symmetric about and arranged along a line of symmetry of the oven, and the first and second ducts are symmetric and positioned adjacent to and on opposite sides of the chamber, heating section, and air return section, thereby forming a symmetric, continuous path.

26. The apparatus of claim 24 further comprising:

a first set of chamber turning vanes to direct circulating air between one of the first and second ducts and the chamber; and a second set of chamber turning vanes to direct circulating air between the other of the first and second ducts and an opposite side of the chamber.

27. The apparatus of claim 24 further comprising:

a first set of top turning vanes to direct circulating air in the top section of one of the first and second ducts toward the middle section of the one duct; and a second set of top turning vanes to direct circulating air in the top section of the other of the first and second ducts toward the middle section of the other duct.

28. The apparatus of claim 24 wherein a first perforated plate separates the bottom section of one of the first and second ducts from the chamber and a second perforated plate separates the other of the first and second ducts from the chamber.

* * * * *